US007721511B2

(12) United States Patent
De Matteis

(10) Patent No.: US 7,721,511 B2
(45) Date of Patent: May 25, 2010

(54) METHOD AND MACHINE FOR BANDING LOGS OF SHEET MATERIAL

(75) Inventor: Alessandro De Matteis, Lucca (IT)

(73) Assignee: MTC-Macchine Trasformazione Carta S.R.L., Pocari (IT)

( * ) Notice: Subject to any disclaimer, the term of this patent is extended or adjusted under 35 U.S.C. 154(b) by 0 days.

(21) Appl. No.: 11/743,825

(22) Filed: May 3, 2007

(65) Prior Publication Data

US 2007/0271872 A1 Nov. 29, 2007

(30) Foreign Application Priority Data

May 26, 2006 (EP) ..... 06010820

(51) Int. Cl.
*B65B 27/08* (2006.01)
*B65B 11/08* (2006.01)

(52) U.S. Cl. ..... 53/399; 53/438; 53/466; 53/529; 53/586; 53/228; 53/202

(58) Field of Classification Search ..... 53/438, 53/529, 399, 466, 586, 228, 230, 202
See application file for complete search history.

(56) References Cited

U.S. PATENT DOCUMENTS 3,006,119 A * 10/1961 Fingerhut ..... 53/438
3,507,089 A * 4/1970 Mizzelle et al. ..... 53/495
3,550,349 A * 12/1970 Breen et al. ..... 53/529
3,584,432 A * 6/1971 Mayer, Jr. ..... 53/496
3,619,976 A * 11/1971 Kerker ..... 53/528
3,648,431 A * 3/1972 Hartbauer et al. ..... 53/528
3,650,087 A * 3/1972 Brinkmeier et al. ..... 53/528
3,747,295 A * 7/1973 Brinkmeier ..... 53/528
3,932,981 A * 1/1976 Fillmann et al. ..... 53/529
4,055,034 A * 10/1977 Brinkmeier ..... 53/528
4,056,919 A * 11/1977 Hirsch ..... 53/529
4,094,130 A * 6/1978 Kelly et al. ..... 53/529
4,141,193 A * 2/1979 Joa ..... 53/529
4,492,070 A * 1/1985 Morse et al. ..... 53/438
4,501,107 A * 2/1985 Piotrowski ..... 53/438
4,679,379 A * 7/1987 Cassoli ..... 53/438
4,805,383 A * 2/1989 Allwein ..... 53/528
4,875,328 A * 10/1989 Meyer ..... 53/529
5,249,408 A * 10/1993 Winnemoller et al. ..... 53/439

(Continued)

FOREIGN PATENT DOCUMENTS

DE 2060753 A * 8/1972

*Primary Examiner*—Stephen F Gerrity
(74) *Attorney, Agent, or Firm*—Dennison, Schultz & MacDonald

(57) ABSTRACT

Banding machine in which logs of sheet material are fed by a conveyor belt to a banding device that is adapted to band the logs with a banding web to form a tubular wrapper around the logs. The banding device includes a pusher operated by an actuator, which pushes the log into a channel, in which a packaging sheet is arranged, stretched in front of the log, as an obstacle. The conveyor belt and the packaging apparatus are arranged at different heights, respectively at a first and a second height (H1 and H2). A pusher is be provided, operated by a piston at the first height (H1), in addition to a pusher provided at the second height (H2), independent from each other. Further, a lifting member is provided, which receives the log from the first pusher and moves from the first height (H1) to the second height (H2).

9 Claims, 5 Drawing Sheets

U.S. PATENT DOCUMENTS 5,282,716 A * 2/1994 Prim et al. ..... 414/790.3
5,406,774 A * 4/1995 Dodge ..... 53/436
5,499,489 A * 3/1996 Perobelli et al. ..... 53/540
6,112,501 A * 9/2000 Pollock ..... 53/399
6,223,500 B1 * 5/2001 Kramps ..... 53/399
6,318,053 B1 * 11/2001 Frank et al. ..... 53/586
6,865,861 B2 * 3/2005 White ..... 53/429
6,922,978 B2 * 8/2005 Gualchierani ..... 53/529
7,243,484 B2 * 7/2007 Allwein ..... 53/529
2005/0044815 A1 * 3/2005 Forte et al. ..... 53/438

* cited by examiner

Fig. 1
(prior art)
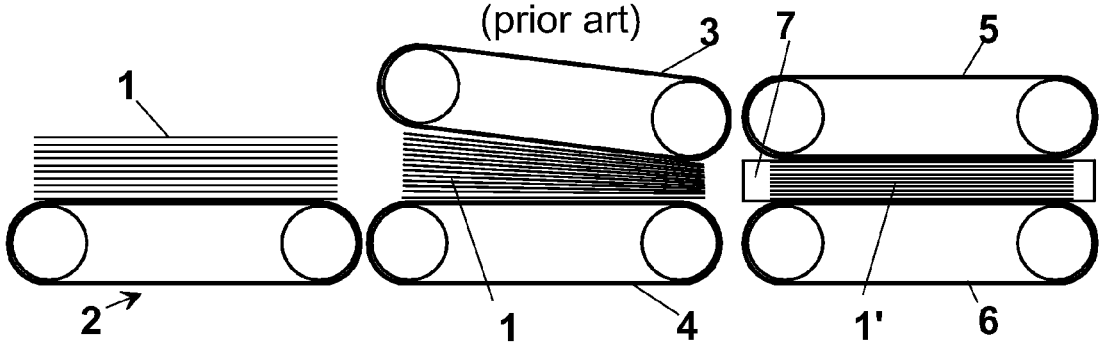
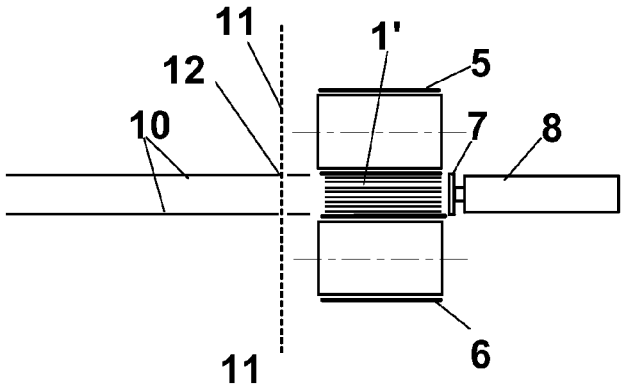
Fig. 2
(prior art)
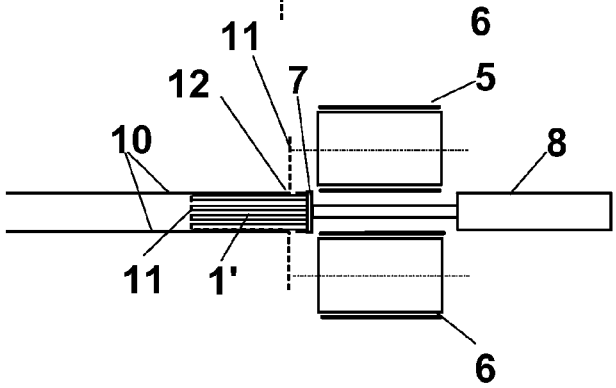
Fig. 3
(prior art)
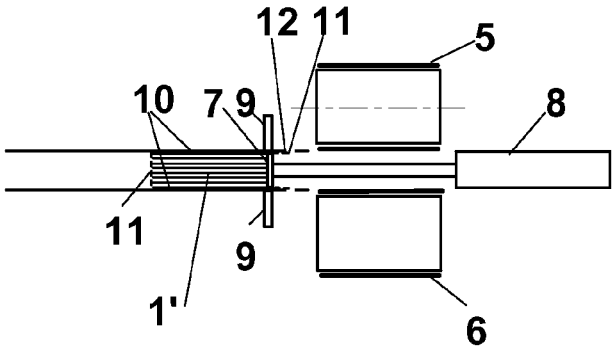
Fig. 4
(prior art)

METHOD AND MACHINE FOR BANDING LOGS OF SHEET MATERIAL

FIELD OF THE INVENTION

The present invention relates to the production of stacks of paper material, and, in particular, it relates to a banding machine for logs of folded, overlapped or interfolded sheet material, for arranging around a log a tubular wrapper of paper and the like.

BACKGROUND OF THE INVENTION

As well known, in the paper converting industry a variety of types is used of machines and of processes for making paper tissues, paper towels and similar articles from stacks of folded, overlapped or interfolded sheets of a certain height.

The stacks are obtained by folding the sheets and simply overlapping them on one another, or by interfolding them, i.e. at each fold a wing of a previous sheet and a wing of a next sheet of the stack engage with each other. This way, when drawing a sheet from a package, in use, a wing of a next sheet of the stack is dragged and pops out from the package, with subsequent practical utilization for certain types of users. Among possible interfolding ways the L-type, with 2 folds (single fold), or the Z or W types, respectively with 3 and 4 folds (multi fold), are known.

After a step of separation of a pack from the stack, once achieved a measured height of the pack, a step follows of conveying the packs or logs for further treatment and packaging.

The stacks of folded or interfolded sheets from which a log is formed have a length that depends on the width of the starting web, normally about 2 meters and more.

For example, in case of logs of interfolded products exiting from the head of an interfolding machine, according to the type of interfolded product and then to the final use, said log can be conveyed to a transversal cutting machine forming small packages of predetermined length and then forwarding them to a binder that places them into customized wrappers tailored for the users. With this solution, normally, the so-called "facial tissue" products are packaged.

Alternatively, the products can be distributed as banded packs or clips, as is the case of "hand towels", which can be placed into special fixed distributors with standard shape. In this case, the whole log of interfolded product, normally, is first compressed and then banded by a web that covers it around, creating a tubular wrapper. The banded log is then cut off into single small packages or clips that are already banded by a corresponding cut tubular wrapper portion.

In the latter case, for carrying out the banding step, banding machines are used that are located downstream of the interfolding machine. In particular, the log of interfolded sheets that have been previously produced and that exit from the interfolding machine can be carried directly into the banding machine by means of an appropriate conveying system, such as a conveyor belt.

A diagrammatical view of the operation of a known banding machine is described in FIGS. 1-4, respectively a longitudinal sectional view and cross sectional views of three successive operation steps with respect to the log. With reference to FIG. 1, a log 1 of interfolded or folded material is carried by a conveyor belt 2 into a banding machine of the prior art. When entering into the banding machine, log 1 follows a path set between two overlapping conveyor belts 3 and 4 that gradually decrease their relative distance in the vertical direction in order to compress log 1, eventually reaching a compressed configuration 1' between two overlapped conveyor belts 5 and 6. Once compressed, the logs are banded by means of a wrapper 11 (FIGS. 2-4) that is cut from a web, by a pusher 7 that is operated by an actuator 8 and pushes log 1 into a channel 10 of the machine in order to carry out the banding step. More precisely, compressed log 1' is pushed into channel 10, and a cut sheet of web 11 is arranged stretched as an obstacle for the log along all the length of the machine, in a passage 12. In a way not shown, the cut sheet of web 11 is automatically unwound from a roll and cut at a predetermined length. Therefore, by the action of a pusher 7, operated by a cylinder piston 8, which pushes the log against the stretched sheet beyond passage 12, a kind of self-packaging is carried out, i.e. the log is wound by the sheet for of its side surface. Then, after the withdrawal of pusher 7, a system of plates 9 transversal to channel 10 is actuated, in order to align to log 1' the remaining wings of sheet 11, on one of which a predetermined amount of glue was previously spread, so that they are closed in turn on the free side of log 1'. Then, further compressed and banded logs are pushed progressively forward against log 1', which moves in channel 10 up to an exit port where it is withdrawn in a way not shown.

In other known systems, instead, there is a movable upper support that compresses the log from the above on a conveyor belt, a predetermined position has been reached, thus reducing the volume and the height of the log before the banding step. For example, a machine of this type is described in EP1636093.

During the forward and back strokes of the pusher, the conveyor belt must stay, for allowing the return stroke of the pusher. For example, in case of a one meter travel of the pusher, i.e. about half meter of forward stroke and half meter of back stroke, a certain time is necessary, which causes a reduction of productivity, for allowing the back stroke of the pusher.

It is therefore desirable to minimize the waiting time to improve productivity.

Concerning the log compression step, a similar system is described in U.S. Pat. No. 6,865,861. In this case, two conveyor belts decrease their relative distance (see also FIG. 1), to improve productivity with respect to the case of a single conveyor belt and pusher. In fact, while in the first case the log is compressed when entering the machine, in the latter case the log must enter completely in the banding machine for pressing it, increasing the waiting time.

In U.S. Pat. No. 6,865,861 there is thus a need to feed the web that is used for wrapping the log, causing the web to be frictionally dragged by the log same. This has the drawback that the speed, and then the productivity, must be low, and the compression of the log cannot be excessive, to avoid break of the banding machine web, or to avoid difficulty of introduction and of drag of the web between the conveyor belts and the log.

SUMMARY OF THE INVENTION

It is therefore a feature of the present invention to provide a structure of banding machine that has a high productivity and at the same time it is as compact as possible.

In particular, it is a feature of the present invention to provide a structure of banding machine that separates the path of the pusher from the path of the conveyor belt for the log, thus increasing productivity.

These and other objects are achieved by a banding machine for logs of folded, overlapped or interfolded sheet material, comprising:

a conveyor belt that is adapted to carry a not compressed log into said banding machine;

means for packaging the log, which arranges a web for banding the log in a position adapted to receive said log and to band it creating a tubular wrapper around it;

pushing means adapted to push said log from said conveyor belt towards said means for packaging;

wherein said conveyor belt and said means for packaging are arranged at different heights, respectively at a first and a second height;

wherein said pushing means have at least a first pusher at said first height and at least a second pusher at said second height independent from each other;

and wherein lifting means are provided adapted to bring a log from said first to said second height, at said first height said first pusher pushing the log from said conveyor belt to said lifting means, and at said second height said second pusher pushing said log from said lifting means against said web into said means for packaging.

Preferably, when passing from said first height to said second height said lifting means compresses at the same time said log.

Advantageously, said lifting means pushes said log against a fixed wall located at said second height, for compressing said log before the intervention of said second pusher.

In an exemplary embodiment, two different means for packaging are provided which are located respectively at said second height and at a third height, wherein said third height is, in particular, less than said first height, said lifting means comprising two lifting platforms that are adapted to operate independently from each other, and that are initially located respectively at the first and at the third height.

This way, while the first plate at the first height receives a log from the conveyor belt and pushes it against the fixed wall which is located at the second height, the second plate moves at the same time from the third height to the first height for receiving a next log. Furthermore, with reference again to the movement from said first height to said third height, the second plate can work as a fixed wall for the log by moving back the second plate from the second height to the first height.

According to another aspect of the invention, a method for banding a log of folded, overlapped or interfolded sheet material comprises at least one of above defined steps.

BRIEF DESCRIPTION OF THE DRAWINGS

Further characteristic and the advantages of the banding machine, according to the invention, will be made clearer with the following description of an exemplary embodiment thereof, exemplifying but not limitative, with reference to the attached drawings, in which like reference characters designate the same or similar parts, throughout the figures of which:

FIGS. 1-4 show a diagrammatical view of the operation of a known banding machine, respectively in a longitudinal sectional view and in cross sectional views of three successive operation steps with respect to the log; FIGS. 1-4 have been described above in the background of the invention;

Figure 5:
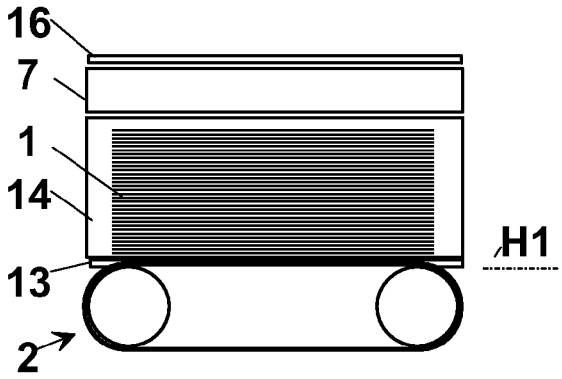
FIGS. 5 and 6 show diagrammatically in a longitudinal cross sectional view two successive steps of operation of a banding machine according to the invention.
Figure 6:
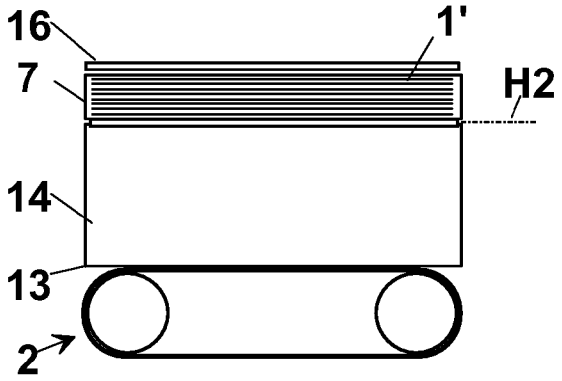

FIGS. from 7 to 11 show diagrammatically a cross sectional view with respect to the log of five operative successive steps of the banding machine of FIGS. 5 and 6 according to the invention;

FIGS. from 12 to 17 show diagrammatically a cross sectional view of six operative successive steps of an exemplary embodiment of the banding machine according to the invention.

DESCRIPTION OF A PREFERRED EXEMPLARY EMBODIMENT

As shown in FIGS. 5-11, relating to a first exemplary embodiment of the invention, a log of interfolded material 1, just produced by an interfolding machine, is carried by a conveyor belt 2 into the banding machine, for example a prior art machine, or an improved banding machine such as that described in U.S. Pat. No. 7,503,153, based on an application filed on the same day as the present application in the name of the same applicant.

When entering the banding machine, log 1 is not compressed and has to be compressed up to reaching a compact shape indicated as 1', for being then fed to a packaging apparatus adapted to band it with a banding web 11 up to form a tubular wrapper around it, in a way similar to that indicated in FIGS. from 2 to 4. The packaging apparatus comprises a pusher 7 that is operated by an actuator 8, which pushes log 1 into a channel 10 in which a packaging sheet 11 is arranged stretched in front of the log, as an obstacle, along all the length of the machine, passing through a passage 12.

According to the invention, conveyor belt 2 and the packaging apparatus are arranged at different heights, respectively at a first and a second height H1 and H2.

A first pusher 14 is provided, operated by a cylinder piston 15 at first height H1, in addition to pusher 7 at second height H2, the pushers being independent from each other. Furthermore, a lifting member 13 is provided, which receives log 1 from the first pusher 14 and moves from first height H1 to second height H2.

Figure 7:
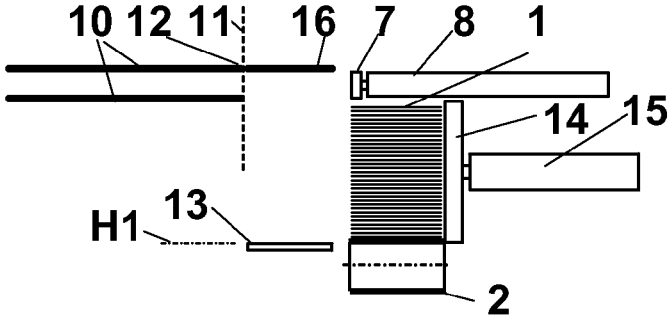
Figure 8:
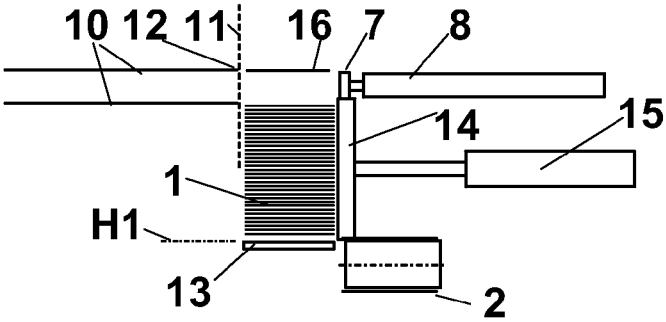

In more detail, as shown in FIGS. 5, 7 and 8, lifting member 13 receives log 1 from conveyor belt 2. When passing from the first height to the second height (FIGS. 6 and 9) lifting member 13 compresses at the same time log 1 against a fixed wall 16, up to reaching a compact configuration 1'.

Then, second pusher 7 starts moving (FIG. 10), causing packaging sheet 11 to band the log, in a known way. In particular, pusher 7 pushes the compacted log 1' into channel 10 against packaging sheet 11, stretched in front of log 1' through passage 12, so that log 1' is wound for ¾ by sheet 11. Then, after the withdrawal of pusher 7, a system of plates 9 (shown only in FIG. 11) that are transversal to channel 10, pushes the remaining wings of sheet 11 adjacent to log 1', on which a predetermined amount of glue was previously spread in a way not shown, causing them to adhere in turn on the free side of log 1'. Logs 1", which are compressed and previously banded (FIG. 10), are pushed progressively forward up to the outlet of channel 10.

The advantage of the invention is that, while lifting member 13 is raised, creating compressed log 1', a next log 1*a* can arrive on the conveyor belt 2 (FIG. 9), and while pusher 7 causes log 1' to be banded (FIG. 10), lifting member 13 can lower again for then receiving (FIG. 11) a next log 1*a*.

In an exemplary embodiment of the invention, shown in FIGS. 12 to 17, two different means for packaging are provided which are located respectively at second height H2, consisting of channel 10 and pusher 7, and at a third height H3, consisting of channel 20 and pusher 17, where the third height H3 is, in particular, lower than first height H1. The lifting means comprises two lifting platforms 13, 23, which are adapted to operate independently from each other, and are initially located respectively at the first and at the third height H1 and H3.

Figure 12:
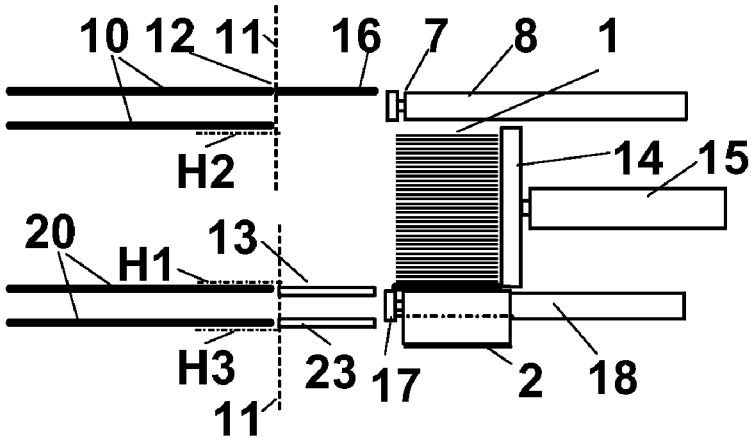
Figure 13:
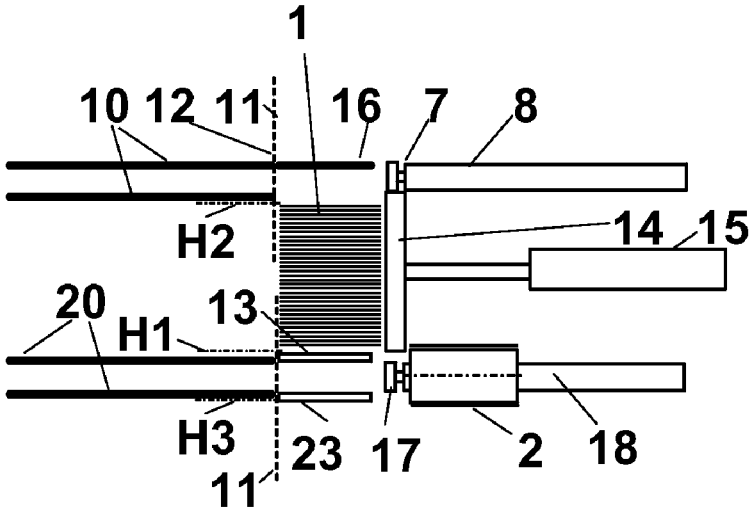

In more detail, as in the previous case, lifting member 13 receives log 1 from conveyor belt 2 (FIGS. 12 and 13). When passing from first height H1 to second height H2 (FIG. 14), lifting member 13 compresses log 1 against fixed wall 16, to attain a compact configuration 1'.

Figure 9:
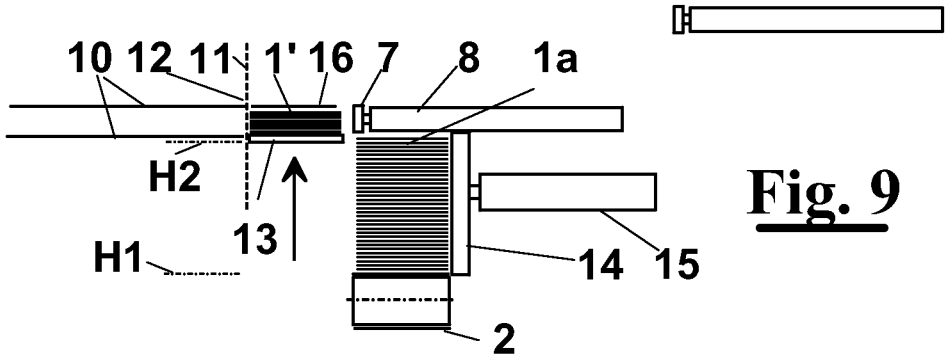
Figure 10:
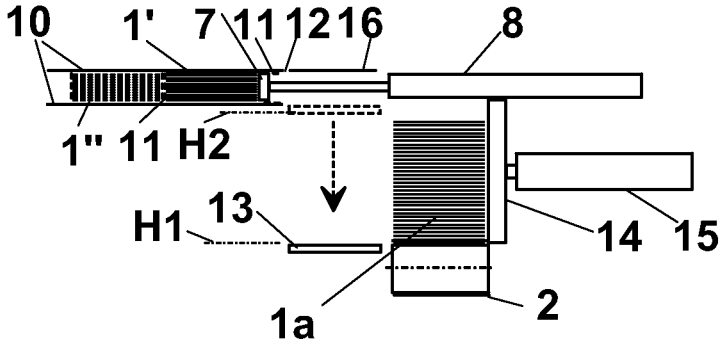
Figure 11:
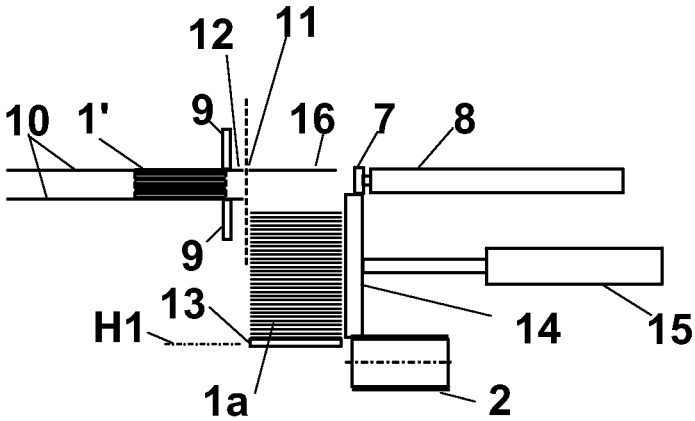

Then, second pusher 7 starts moving (FIG. 15), causing packaging sheet 11 to band the log, in a manner similar to that described with reference to FIGS. 9 and 10.

Figure 14:
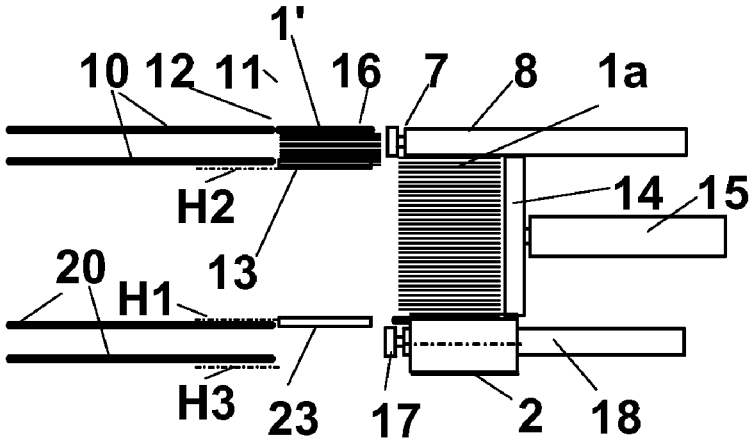
Figure 15:
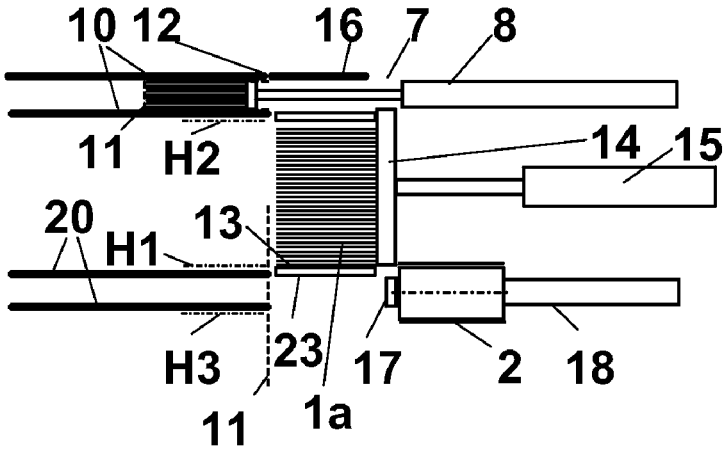
Figure 16:
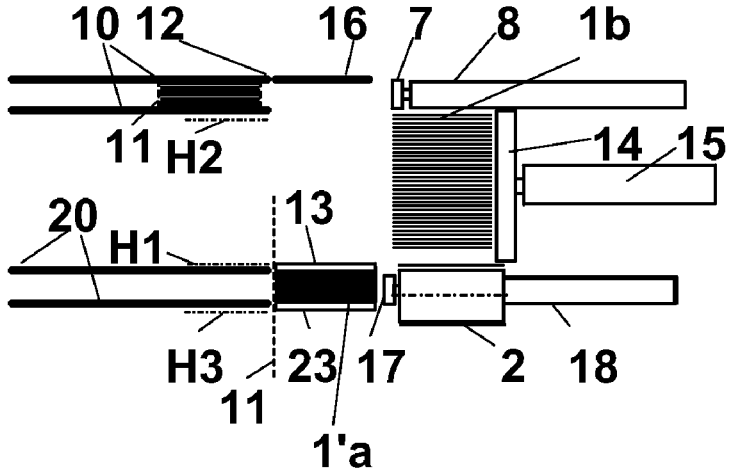
Figure 17:
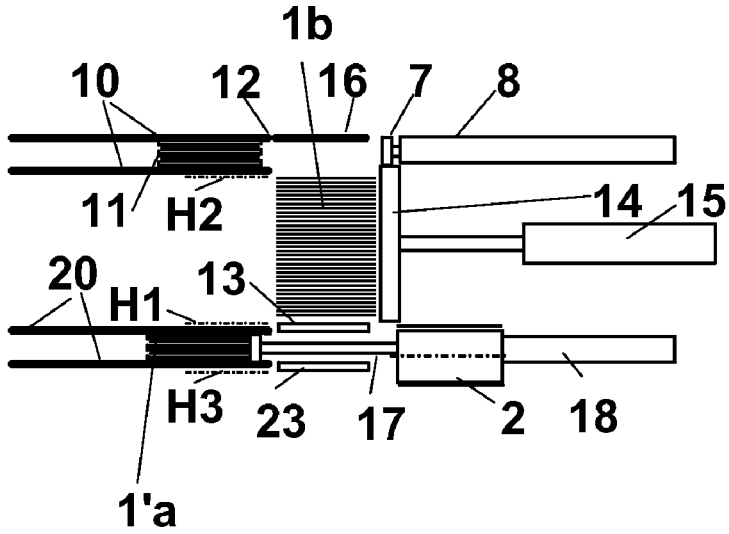

In the meantime, while lifting member 13 is raised creating compressed log 1', a log 1*a* is waiting on belt 2 (FIG. 14). Second lifting member 23 is then brought to first height H1 for receiving it and when pusher 7 has started to band log 1', pusher 14 moves log 1*a* onto second lifting member 23 (FIG. 15). In the meantime, a log 1*b* is waiting on web 2 (FIG. 16). Second lifting member 23 is at the same time brought to third height H3 along with log 1*a* and, when pusher 7 has started to band log 1', first lifting member 13 can lower again to first height H1, compressing log 1*a* that was present on lifting member 23 at third height H3, creating a compressed log 1'*a* (FIG. 16). Finally, while pusher 17 causes log 1'*a* to be banded (FIG. 17), lifting member 13, which has been lowered back to height H1, can receive next log 1*b*.

This solution is particularly compact and integrates two banding devices, thus allowing logs to be received on the conveyor belt at higher rate and to deliver them immediately.

Notwithstanding in the description reference has been made to a step of compression of the log when passing from the first to the second height, it is possible that the log can arrive on conveyor belt 2 after it has already been compressed. Even in this case, the log is fed to the banding machine at different heights with respect to pusher 7, with higher productivity since conveyor belt 2 or other conveyor belts need not await the end of the stroke of pusher 7 in either direction, in order to supply a log for banding.

The foregoing description of a specific embodiment will so fully reveal the invention according to the conceptual point of view, so that others, by applying current knowledge, will be able to modify and/or adapt for various applications such an embodiment without further research and without parting from the invention, and it is therefore to be understood that such adaptations and modifications will have to be considered as equivalent to the specific embodiment. The means and the materials to realise the different functions described herein could have a different nature without, for this reason, departing from the field of the invention. It is to be understood that the phraseology or terminology employed herein is for the purpose of description and not of limitation.

The invention claimed is:

1. Banding machine for logs of sheet material, comprising:

a conveyor belt adapted to carry a log in said banding machine;

means for packaging the log, said means for packaging being adapted to put a web for banding the log in a position adapted to receive the log and to band the log, thereby creating a tubular wrapper around the log; and pushing means adapted to push the log from said conveyor belt towards said means for packaging;

wherein said conveyor belt and said means for packaging are arranged at different heights, respectively at a first and a second height;

wherein said pushing means comprises at least a first pusher at said first height and at least a second pusher at said second height independent from each other;

wherein a lifting means is provided constructed and arranged to bring a log from said first to said second height, at said first height said first pusher pushing the log from said conveyor belt to said lifting means, and at said second height said second pusher pushing the log from said lifting means against the web in said means for packaging; and wherein two different means for packaging are provided which are located respectively at said second height and at a third height.

2. Banding machine according to claim 1, wherein when passing from said first height to said second height, said lifting means compresses the log at the same time.

3. Banding machine according to claim 1, wherein a fixed wall is provided located at said second height against which said lifting means pushes the log for compressing the log before intervention of said second pusher.

4. Banding machine according to claim 1, wherein said third height is lower than said first height.

5. Banding machine according to claim 1, wherein said lifting means comprises two lifting platforms adapted to operate independently from each other, initially located respectively at the first and at the third height.

6. A method for banding a log of sheet material, comprising the steps of:

conveying a log in a banding machine;

packaging the log, by bringing a banding web in a position adapted to receive the log and to band the log, thereby creating a tubular wrapper around the log;

pushing the log from said conveyor belt towards said banding web for causing said banding;

wherein said step of conveying and said step of packaging occur at different heights, respectively at a first and a second height;

wherein said step of conveying the log is carried out at said first height;

wherein said step of pushing is carried out in part at said first height and in part at said second height independently;

wherein a step is provided of passage of the log from said first to said second height between said two pushing steps; and wherein two different packaging steps are carried out, respectively, at said second height and at a third height.

7. Method according to claim 6, wherein when passing from said first height to said second height, or from said first height to said third height, the log is compressed.

8. Method according to claim 6, wherein said third height is lower than said first height.

9. Method according to claim 6, wherein two different steps of passage of a log are provided, from said first to said second height and from said first to said third height.

* * * * *